United States Patent [19]

Seynhaeve

[11] 4,456,105

[45] Jun. 26, 1984

[54] PIECE OF LUGGAGE, MORE ESPECIALLY A SUITCASE OR DOCUMENT CASE

[75] Inventor: Andre G. Seynhaeve, Senlis, France

[73] Assignee: Societe Delsey, Bobigny, France

[21] Appl. No.: 331,759

[22] Filed: Dec. 17, 1981

[30] Foreign Application Priority Data

Jan. 2, 1981 [FR] France ..... 81 00021

[51] Int. Cl.[3] ..... A45C 13/10; A45C 13/28

[52] U.S. Cl. ..... 190/115; 190/121

[58] Field of Search ..... 190/55 R, 56, 55 A, 190/57, 58 R, 58 A, 58 B, 58 C, 39, 115, 119, 120, 121, 900; 70/64, 69, 70; 292/DIG. 48

[56] References Cited

U.S. PATENT DOCUMENTS

| | | | |
|---|---|---|---|
| 1,596,561 | 8/1926 | Tueckmantel | 190/56 X |
| 2,213,821 | 9/1940 | McCurdy | 190/56 X |
| 3,479,702 | 11/1969 | Szabo | 190/58 B X |
| 3,646,787 | 3/1972 | Norrenberg-Sudhaus | 70/70 |

FOREIGN PATENT DOCUMENTS

| | | | |
|---|---|---|---|
| 1505452 | 12/1967 | France | 70/69 |
| 265067 | 2/1950 | Switzerland | 190/56 |
| 615328 | 1/1980 | Switzerland | 190/55 R |

*Primary Examiner*—William Price
*Assistant Examiner*—Sue A. Weaver
*Attorney, Agent, or Firm*—Oblon, Fisher, Spivak, McClelland & Maier

[57] ABSTRACT

The piece of luggage provided by the invention comprises a bottom (1) to which is hinged a lid (2), a handle (3) provided with means for mounting same on the external face of the front wall of the bottom, and two closure devices (26) each adapted to cooperate with a keeper (4) for locking the lid to the bottom. It is characterized in that the keepers (4) are formed in a separate unit which is fixed against the internal face of the front wall of the bottom by the handle-mounting means; and in that the closure devices (26) are mounted on the front wall of the lid (2) and each comprise a hook (27) adapted to engage with the corresponding keeper when the lid is closed.

13 Claims, 12 Drawing Figures

PIECE OF LUGGAGE, MORE ESPECIALLY A SUITCASE OR DOCUMENT CASE

BACKGROUND OF THE INVENTION

The present invention relates to a piece of luggage, particularly a suitcase or a document case, of the type comprising a bottom to which a lid is hinged, a handle provided with means for fitting it to the external face of the front wall of the bottom, and two closure devices each capable of cooperating with a keeper for locking the lid to the bottom.

The keepers of present luggage are small fittings secured independently of each other by appropriate means such as screws or rivets. Presently, the positioning of these securing means is time-consuming and delicate. It is furthermore particularly expensive, more especially because it requires large personnel costs.

SUMMARY OF THE INVENTION

The present invention proposes remedying these disadvantages and, for this, it provides a piece of luggage of the above-mentioned type which is characterized in that the keepers are formed in a single separate unit which is secured against the internal face of the front wall of the bottom by the means for fitting the handle, and in that the closure devices are mounted on the front wall of the lid and each comprise a hook capable of engaging the corresponding keeper when the lid is closed.

The time required for fixing the keepers now corresponds to the time required for fixing the separate unit and is much shorter than heretofore. Furthermore, since the means for fitting the handle also serve for securing the separate unit, the specific means which were required for fixing the keepers need no longer be used, which allows a considerable reduction in the cost price of the luggage.

Advantageously, the separate unit is inserted between two parallel gutters provided on the internal face of a metal shaped section forming the lateral walls of the bottom, these gutters being turned towards each other, and each receiving one of the longitudinal sides of the separate unit.

The two gutters firmly maintain the separate unit against the internal face of the front wall of the bottom of the luggage, even if the means for mounting the handle were no longer to satisfactorily exercise their function. The risks of the separate unit being accidentally separated from the bottom of the luggage are thus eliminated.

It will be here noted that the two gutters further contribute to strengthening the lateral walls of the bottom of the piece of luggage.

Preferably, the lower longitudinal side of the separate unit ends in a downwardly-turned vertical rectilinear tongue whereas its upper longitudinal side is extended by upwardly-turned rectilinear ribs bevelled on their face situated on the metal shaped section side.

In order to insert the separate unit between the two gutters, it is sufficient to fit the tongue of its lower longitudinal sides into the lower gutter, then to exert a pressure on its upper longitudinal side so as to snap-fit the ribs thereof into the upper gutter. The snap-fit of the ribs is obviously facilitated by the presence of the bevels which these latter comprise on their face situated on the shaped metal section side.

According to a preferred embodiment, the keepers are formed by longitudinal recesses provided in the vicinity of the ends of the upper longitudinal side of the separate unit, which is flat and horizontal.

It will be readily understood that the construction of the keepers poses in this place no problem, especially if the separate unit is made from a moulded plastic material.

Preferably, the separate unit comprises two depressions on its face which is turned inwardly of the bottom, these depressions being situated between the two keepers and each provided with a bore for passing therethrough the means for mounting the handle.

The depressions have the advantage of serving as housings for the handle-mounting means. They thus avoid these latter projecting inside the bottom of the piece of luggage and reducing the storage capacity thereof.

Advantageously, the separate unit comprises at least one retractable finger passing through a bore in its upper longitudinal side, this finger comprising, at its end which is situated under the upper longitudinal side of the separate unit, a shoe against which bears one of the ends of a compression spring whose other end rests on a base provided on the separate unit.

During unlocking of the closure devices holding the lid in the closed position, the retractable finger rises under the thrust of the spring and slightly raises the lid, the opening of which then becomes easier.

According to a preferred embodiment of the piece of luggage in accordance with the invention, the closure devices are further slidably mounted on a second separate unit fixed against the internal face of the front wall of the lid and each comprise an operating button accessible from the outside through a longitudinal opening provided in said front wall.

The fitting of the closure devices is in its turn very rapid since it is limited to securing the separate unit on which they are mounted.

Preferably, the second separate unit comprises a longitudinal groove receiving a rib provided on the internal face of a shaped metal section crimped at the periphery of the lid.

The positioning of the second separate unit may thus be achieved without proceeding by trial and error. In fact, the rib of the shaped section and the longitudinal groove of the second separate unit form reference points for rapidly bringing this latter into its correct position. The securing of the second separate unit to the lid is furthermore more rigid and more reliable.

Advantageously, the closure devices each comprise a groove forming an extension of the groove of the second separate unit and receiving in its turn the groove of the shaped metal section.

Because of their groove, the closure devices are perfectly guided when they slide over the second separate unit and therefore do not risk being accidentally jammed.

To facilitate their operation, it is moreover advantageous for the closure devices to be movable against the action of return springs urging them into their locking position. All that the user has in fact to do is to bring them into their open position, the springs automatically returning them to their locking position.

BRIEF DESCRIPTION OF THE DRAWINGS

Other characteristics and advantages of the invention will become clear from the following description, given solely by way of example and in no wise limiting, with reference to and accompanying drawings in which.

DETAILED DESCRIPTION OF THE PREFERRED EMBODIMENTS

Figure 1:
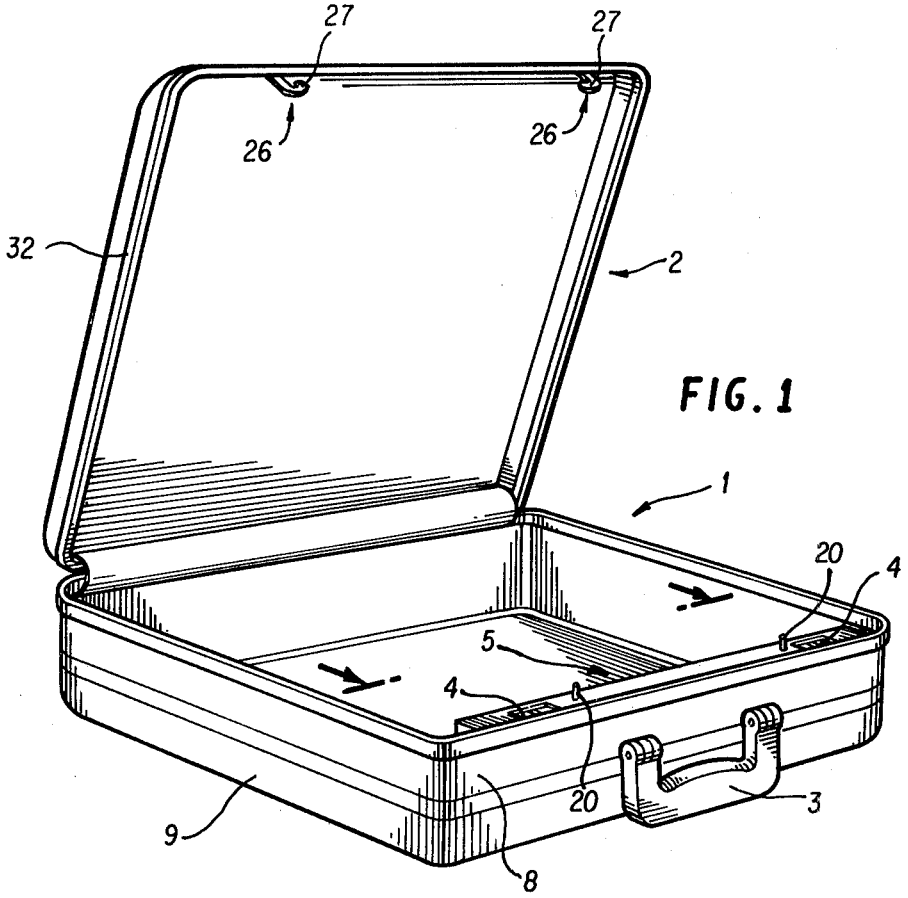
FIG. 1 is a perspective view of a document case in accordance with the invention.

The document case which can be seen in FIG. 1 comprises, in a quite conventional way, a bottom 1 and a lid 2 hinged to one another by means of hinges, not shown, connecting together their rear walls.

The bottom 1 comprises a handle 3 projecting from the external face of its front wall. It also comprises two keepers 4 constructed as a separate unit 5, preferably from a moulded plastic material, fixed against the internal face of its front wall.

Figure 5:
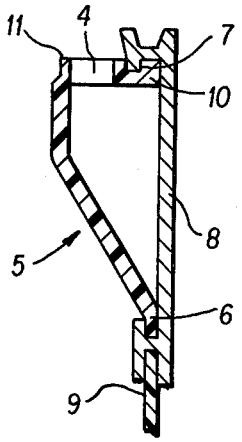
FIG. 5 is a sectional view along line V—V of FIG. 2.
Figure 6:
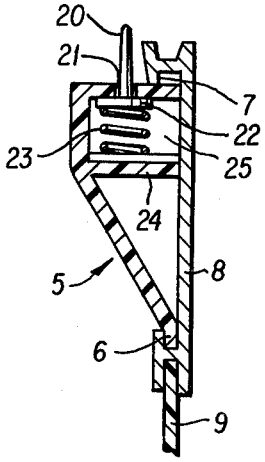
FIG. 6 is a sectional view along line VI—VI of FIG. 2.
Figure 7:
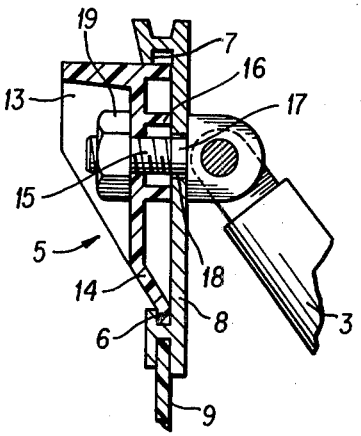
FIG. 7 is a sectional view along line VII—VII of FIG. 2.
Figure 2:
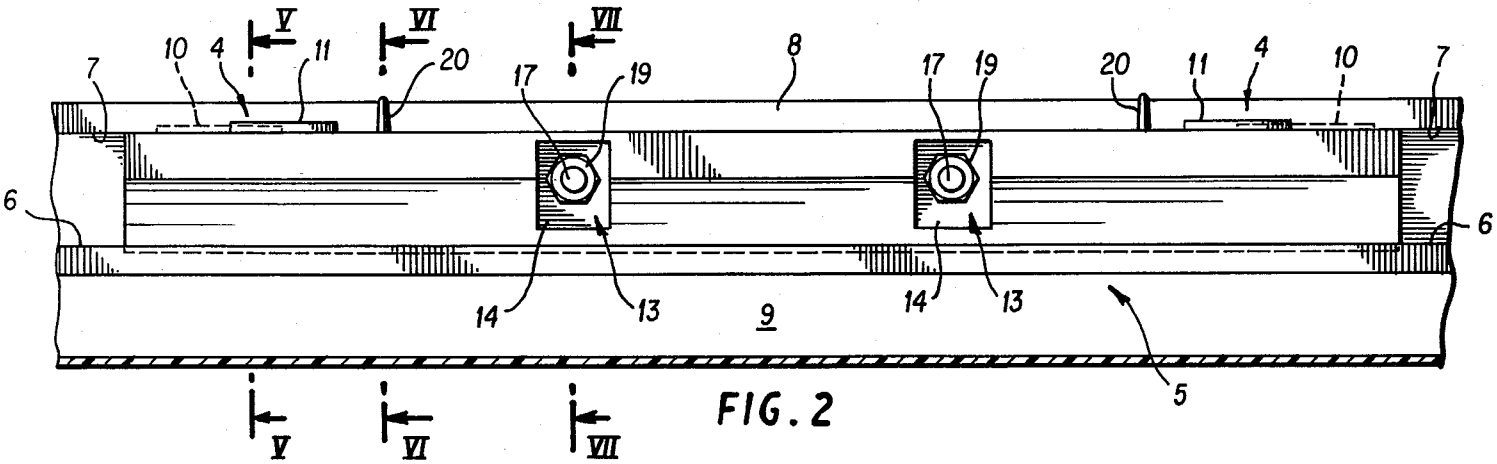
FIG. 2 is a front elevational view of the separate unit comprising the keepers of the case, this view being taken in the direction of arrows II—II of FIG. 1.

As can be seen in FIG. 2 and in the sectional views shown in FIGS. 5 to 7, the separate unit 5 is inserted between two parallel gutters 6 and 7 formed in the internal face of a shaped metal section 8 forming the lateral walls of bottom 1, the two gutters being turned towards each other whereas the shaped section 8 is crimped at the periphery of a plastic material shell 9 forming the lower wall of bottom 1.

The lower longitudinal side of the separate unit 5 ends in a vertically downward-extending rectilinear tongue which is received inside the lower gutter 6. As for its upper longitudinal side, which is flat and horizontal, it comprises in the vicinity of its ends, two upwardly-turned rectilinear ribs 10 bevelled on their face turned towards the shaped section 8 and snap-fitted into the upper gutter 7 thereof.

In order to mount the separate unit 5 against the internal face of shaped section 8, the rectilinear tongue thereof is fitted into the lower gutter 6, then a pressure directed towards shaped section 8 is exerted against its upper longitudinal side so as to force-fit ribs 10 in gutter 7.

Figure 3:
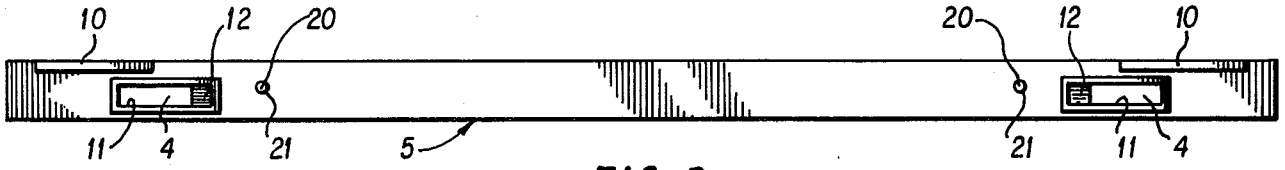
FIG. 3 is a top view of the separate unit.

Referring in particular to FIGS. 3 and 5, it will be noted that keepers 4 are formed by longitudinal recesses formed in the vicinity of the ends of the upper longitudinal side of the separate unit 5. Each recess is surrounded by an upwardly-projecting peripheral flange 11 and comprises on its transverse side situated on the handle side, an inclined wall 12 sloping downwards in the direction of its other transverse wall (see FIG. 3).

Referring now to FIGS. 2 and 7, it will be further noted that the separate unit comprises two depressions 13 on its face turned towards the inside of the bottom 1 of the piece of luggage.

These two depressions, which are situated between keepers 4, each comprise a bottom 14 extending parallel to the shaped section 8. As can be seen in FIG. 7, bottom 14 is provided with a bore 15 opening inside an annular collar 16 whose free end bears against shaped section 8, between the two gutters thereof.

Each bore 15 has passing therethrough a threaded rod 17 to which is pivoted one of the ends of handle 3, this threaded rod passing through a bore 18 formed in shaped section 8 whereas its free end receives a nut 19 bearing against the bottom 14 of the corresponding depression.

As shown in FIG. 7, the threaded rods 17 and nuts 19 allow handle 3 to be mounted while securing the separate unit 5 against the internal face of the front wall of bottom 1.

Figure 4:
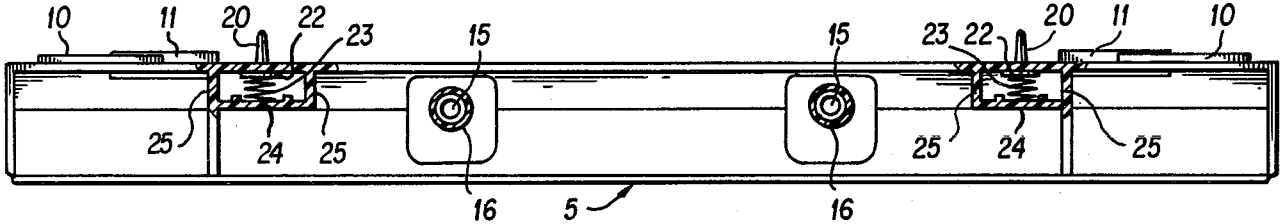
FIG. 4 is a rear elevational view of the separate unit.

Referring more particularly to FIGS. 4 and 6, it will also be noted that the separate unit 5 comprises two retractable fingers 20 projecting from its upper longitudinal side. These retractable fingers are situated between a keeper and the adjacent depression 13. They pass through a bore 21 formed in the upper longitudinal side of the separate unit 5 and comprise, at the end thereof which is situated under this side, a shoe 22 against which bears one of the ends of a helical spring 23 whose other end rests on a horizontal base 24 of the separate unit 5. As can be seen in FIGS. 4 and 6, base 24 bears against shaped section 8 and is connected to the upper longitudinal side of the separate unit 5 by means of two vertical plate portions 25.

Because of springs 23 which urge them upwardly, retractable fingers 20 move lid 2 slightly away from bottom 1 during unlocking of the closure devices 26 of the case, which will be described hereafter with reference to FIGS. 8 to 12.

These closure devices are carried by the front wall of lid 2 and each comprise a hook 27 able to engage with the inclined wall 12 of the corresponding keeper when the lid is closed. They are slidably mounted on a second separate unit 28 fixed against the internal face of the front wall of the lid and each comprises an operating button 29 which is accessible from outside, through a longitudinal opening provided in the front wall of the lid (see FIG. 9).

The second separate unit 28 comprises a longitudinal groove 30 receiving a rib 31 (visible in FIG. 9) provided on the internal face of a shaped metal section 32 crimped at the periphery of lid 2.

Figure 10:
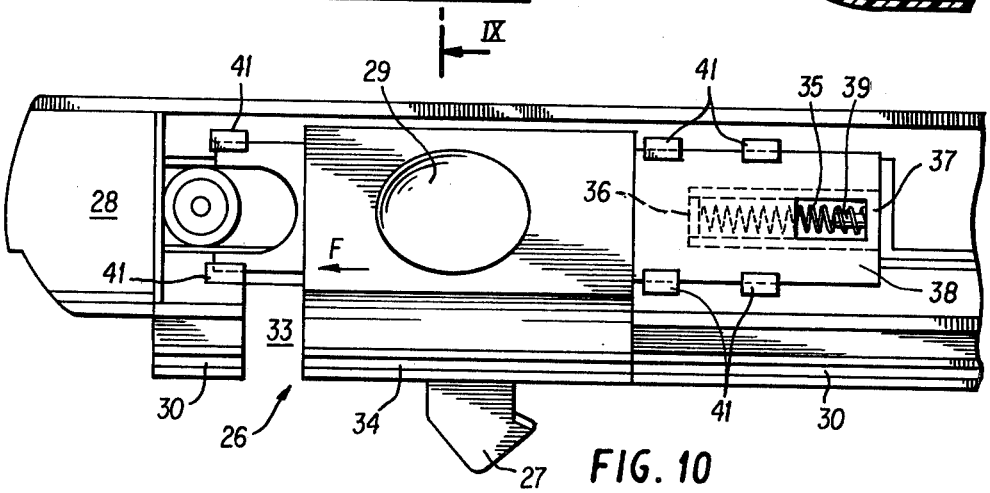
FIG. 10 is a top view of one of the ends of the second separate unit, a closure device being mounted thereon.
Figure 11:
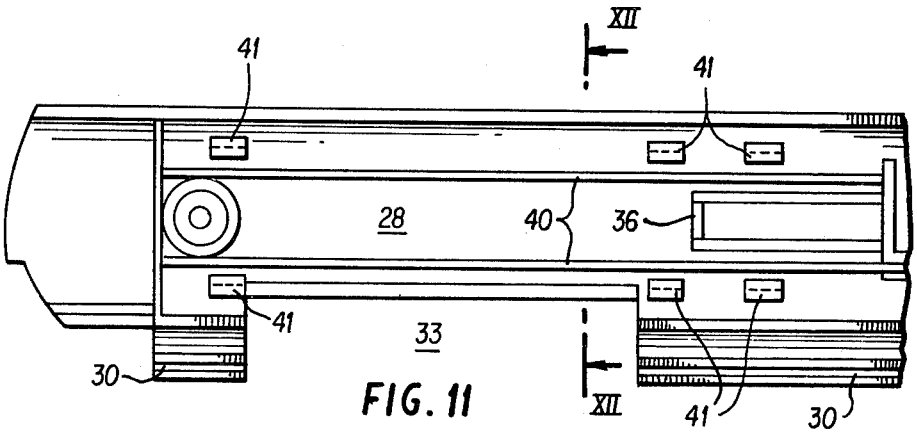
FIG. 11 is a view similar to that of FIG. 10 but in which the closure device has been removed.

As shown in FIGS. 10 and 11, the separate unit 28 is provided, at the position of the closure devices, with a cut-out 33 at right angles to which its groove 30 is interrupted.

Figure 9:
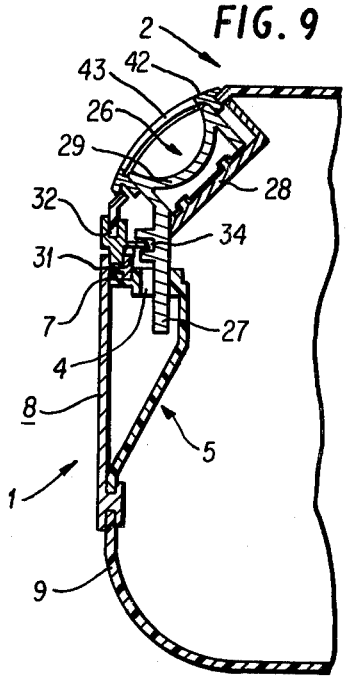
FIG. 9 is a sectional view along line IX—IX of FIG. 8.

The closure devices, which penetrate into the cut-outs 33, each comprise a groove 34 situated in the extension of groove 30 of the separate unit 28 and into which the rib 31 of shaped section 32 penetrates (see FIG. 9). They are movable longitudinally into the cut-outs 33 against the action of return springs 35. Each spring is placed between a fixed stop 36 provided on unit 28 and the transverse side 37 of a recessed tongue 38 extending the corresponding closure device 26 in the direction of the other closure device. As can be seen in FIG. 10, the transverse side 37 is provided with a longitudinal stud 39 extending in the direction of stop 36 and preventing spring 35 from escaping accidentally.

It will be readily understood that spring 35 is compressed when the closure device 26, shown in FIG. 10, is moved in the direction of arrow F and that it expands while bringing the closure device back into the position shown when this latter is not subjected to the action of any force.

Figure 12:
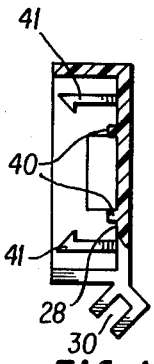
FIG. 12 is a sectional view along line XII—XII of FIG. 11.

Referring to FIGS. 11 and 12, it will be further noticed that each closure device 26 is movable along two longitudinal slides 40 formed on the upper face of separate unit 28 and that it is further guided along this face by lugs 41 encompassing it laterally and ending in protuberances projecting slightly thereabove.

Figure 8:
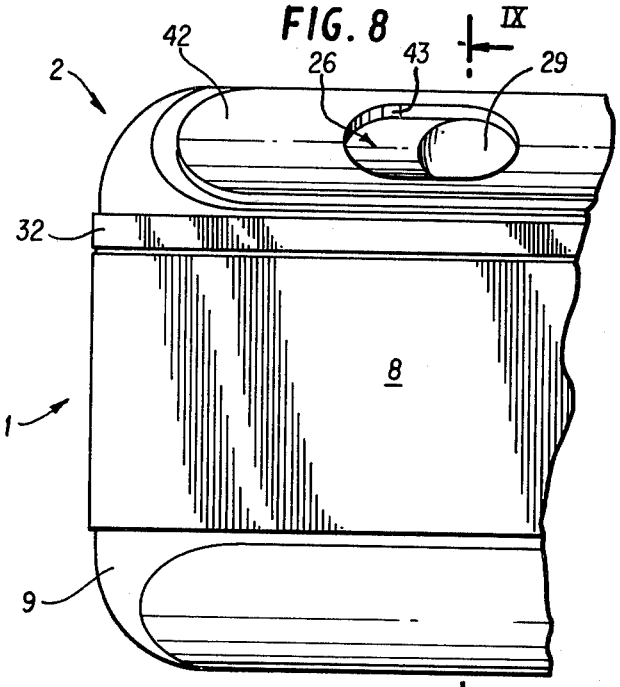
FIG. 8 is a partial view of the front face of the case, the lid thereof being in a closed position.

For the sake of completeness, it will be finally mentioned that the separate unit 28 is fixed by screws, not shown, connecting it to an external plate 42 bearing on the edges of the longitudinal opening of the front wall of lid 2, this plate being provided with recesses 43 through which the closure devices are accessible from outside (see FIGS. 8 and 9).

It should finally be noted that the document case of the invention in much more practical in use than present cases. In fact, the positioning of the closure devices on the front face of the lid makes them more visible. Up to present, these devices were on the front face of the bottom, at places which were not very visible and difficult of access because of the presence of the handle.

Furthermore, with the closure devices located on the lid, a single gesture is required for opening and gripping the lid in order to bring it into its open position.

What is claimed as new and desired to be secured by Letters Patent of the United States is:

1. A piece of luggage, more especially a suitcase or document case, of the type comprising a bottom to which a lid is hinged, a handle provided with means for mounting same on the external face of the front wall of the bottom and two closure devices each adapted to cooperate with a keeper for locking the lid to the bottom, characterized in that the keepers (4) are made as a single separate unit (5) which has two longitudinal sides and two bores and which is fixed against the internal face of the front wall of the bottom (1) by the means (17, 19) for mounting a handle (3), said separate unit being inserted between two parallel gutters (6, 7) provided on the internal face of a shaped metal section (8) forming the lateral walls of the bottom (1), these two gutters being turned towards one another and each receiving one of the longitudinal sides of the separate unit, said means for mounting passing through said bores, and in that the closure devices (26) are mounted on the front wall of the lid (2) and each closure device comprises a hook (27) adapted to engage with the corresponding keeper when the lid is closed, wherein said keepers are located on opposite sides of said means for mounting the handle.

2. The piece of luggage as claimed in claim 1, characterized in that a lower one of said longitudinal sides of the separate unit ends in a downwardly-turned vertical rectilinear tongue whereas an upper one of said longitudinal sides is extended by upwardly-turned rectilinear ribs (10) bevelled on their face situated on the shaped metal section side (8).

3. The piece of luggage as claimed in claim 1, characterized in that the keepers (4) are formed by longitudinal recesses provided in the vicinity of the ends of an upper one of said longitudinal sides of the separate unit (5).

4. The piece of luggage as claimed in claim 3, characterized in that an upper one of said longitudinal sides of the separate unit (5) is flat and horizontal.

5. The piece of luggage as claimed in claim 1, characterized in that the separate unit (5) comprises two depressions (13) on its face which is turned towards the inside of the bottom (1), said bores extending into said depressions.

6. The piece of luggage according to claim 1, characterized in that the separate unit (5) comprises at least one retractable finger (20) passing through a bore (21) provided in an upper one of said longitudinal sides, this finger carrying, at its end which is situated under the upper longitudinal side of the separate unit, a shoe (22) against which bears one of the ends of a compression spring (23) whose other end rests on a base (24) provided on the separate unit.

7. The piece of luggage as claimed in claim 1, characterized in that the closure devices (26) are slidably mounted on a second separate unit (28) fixed against the internal face of the front wall of the lid (2) and each comprising an operating button (29) accessible from the outside through a longitudinal opening provided in said front wall.

8. The piece of luggage as claimed in claim 7, characterized in that the second separate unit (28) comprises a longitudinal groove (30) receiving a rib (31) provided on the internal face of a shaped metal section (32) crimped at the periphery of the lid (2).

9. The piece of luggage as claimed in claim 8, characterized in that the closure devices (26) each comprise a groove (34) situated in an extension of said longitudinal groove of the second separate unit (28) and receiving in its turn the rib (31) of the shaped metal section (32).

10. The piece of luggage as claimed in claim 7, characterized in that the closure devices (26) are movable against the action of return springs (35) urging them into their locking position.

11. The piece of luggage as claimed in claim 7, characterized in that the closure devices (26) are movable along parallel slides (40) on the face of the second separate unit (28) which is turned towards the longitudinal opening provided in the front wall of the lid (2).

12. The piece of luggage as claimed in claim 11, characterized in that the closure devices (26) are further guided by lugs (41) encompassing them laterally and ending in protuberances projecting slightly above them.

13. The piece of luggage as claimed in claim 7, characterized in that the second separate unit (28) is fixed by means connecting it to an external plate (42) bearing on the edges of the longitudinal opening in the front wall of the lid (2), this plate being provided with recesses (43) through which the closure devices are accessible from the outside.

* * * * *